US008303440B1

(12) United States Patent
Lee

(10) Patent No.: US 8,303,440 B1
(45) Date of Patent: Nov. 6, 2012

(54) POSITIONING DEVICE FOR HOLDING MEMBER OF SPORT RACKET STRINGING MACHINE

(76) Inventor: Min-Wei Lee, Kaohsiung (TW)

( * ) Notice: Subject to any disclaimer, the term of this patent is extended or adjusted under 35 U.S.C. 154(b) by 0 days.

(21) Appl. No.: 13/348,642

(22) Filed: Jan. 12, 2012

(51) Int. Cl.
*A63B 51/14* (2006.01)

(52) U.S. Cl. ..... 473/555

(58) Field of Classification Search ..... 473/555–557
See application file for complete search history.

(56) References Cited

U.S. PATENT DOCUMENTS 4,546,977 A * 10/1985 Bosworth et al. ..... 473/555
4,706,955 A * 11/1987 Ngadi et al. ..... 473/555
5,090,697 A * 2/1992 Lee ..... 473/555
5,186,505 A * 2/1993 Chu ..... 473/555
6,764,418 B1 * 7/2004 Lee ..... 473/557

* cited by examiner

*Primary Examiner* — Raleigh W. Chiu

(57) ABSTRACT

A positioning device for holding member of a sport racket stringing machine includes a rack which is engaged with the top board of the stringing machine and has multiple one-way ratchet teeth. The holding member has a chamber and a contact member is movably located in the chamber and inclinedly engaged with the ratchet teeth of the rack to position the holding member. A spring is connected between the body and the contact member to urge the contact member to contact the rack. The operation member is pivotably connected to the chamber. The operation member has a driving portion and a positioning portion with a curved operation portion connected therebetween. The operation portion is pivotably connected to the body. The top end of the contact member extends between the driving portion and the positioning portion and the driving portion pivots the contact member to move the holding member.

5 Claims, 6 Drawing Sheets

POSITIONING DEVICE FOR HOLDING MEMBER OF SPORT RACKET STRINGING MACHINE

FIELD OF THE INVENTION

The present invention relates to a sport racket stringing machine, and more particularly, to a positioning device for holding member of a sport racket stringing machine.

BACKGROUND OF THE INVENTION

The sport rackets, such as the tennis rackets or badminton rackets, have an enclosed head with strings located within the head and the tension of the strings can effectively hit the balls and the players control the direction that the balls fly partially by the tension of the strings. The tension of the strings is formed by the pulling forces applied to the strings. In order to control that all of the strings have the precise tension, the stringing process is made by using the stringing machine.

There are a pair of holding members for holding the head of the racket before stringing, as shown in FIGS. 1 and 2, the positioning device for holding member of the conventional stringing machine comprises a guide board 2 fixed on the top board 1 of the stringing machine and the guide board 2 has an elongate slot 202 defined axially in the guide board 20. The base 4 of the holding members 3 is connected to the top of the guide board 2 and a bottom board 402 is connected to the hollow portion of the lower part of the base 4. The bottom board 402 has two pins 404 extending from the underside thereof and engaged with the guide slot 202. A bolt 5 extends from the underside of the top board 1 and the guide slot 202 and is cooperated with a washer 504. By rotating the head 502 of the bolt 5 to loose the bolt 5, the base 4 can be moved along the guide slot 202. When the base 4 is moved to a desired position, the bolt 5 is tightened to position the holding members 3 so that the head of the rackets of different brands can be held.

The heads of the rackets of different brands have different sizes and shapes, so that the distance between the holding members 3 may be varied according to the different heads of rackets. Therefore, the holding members 3 cannot be set at a fixed position due to the different sizes of the heads of rackets. In order to save space, the holding members 3 are moved toward each other when not in use, so that the users have to release and tighten the bolts repeatedly to set the holding members 3 between the operation status and the non-operation status. This wastes time for the users.

The present invention intends to provide a positioning device for the holding member to improve the shortcoming of the conventional one.

SUMMARY OF THE INVENTION

The present invention relates to a positioning device for holding member of a sport racket stringing machine and comprises a rack, a contact member, an operation member and a spring. The rack is engaged with the top board of the stringing machine and has multiple one-way ratchet teeth. The holding member has a body connected to the top of the top board and the body has a chamber which is located adjacent to the rack. The contact member is movably located in the chamber and its lower end is inclinedly engaged with the ratchet teeth of the rack so as to position a holding member. The spring is located in the chamber and connected between the body and the contact member so as to urge the contact member to be in contact with the rack. The operation member is a hook-shaped board and pivotably connected to the chamber. The operation member has a driving portion and a positioning portion with a curved operation portion connected therebetween. The operation portion protrudes out from the body and is pivotably connected to the body. The top end of the contact member extends between the driving portion and the positioning portion and the driving portion pivots the contact member to move the holding member.

Preferably, the operation member has a restriction slot defined in one side thereof and a restriction rod extends through the restriction slot. The restriction rod has one end connected to the body to restrict the range of the operation member.

Preferably, the contact member has a pivot extending through the central portion thereof and the pivot is pivotably connected between two insides of the chamber so that the contact member is pivotable about the pivot.

Preferably, the spring has the first end mounted to a positioning pin which is threadedly connected to the body, and a distal end of the first end of the spring contacts the inside of the chamber. The second end of the spring is connected to the contact member to position the spring.

Preferably, the top board has a support board at the underside thereof and the support board positions the rack.

The primary object of the present invention is to provide a positioning device for holding member of a sport racket stringing machine and the contact member is pivotable and engaged with the rack so that the holding member can be smoothly and conveniently moved relative to the top board of the stringing machine.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
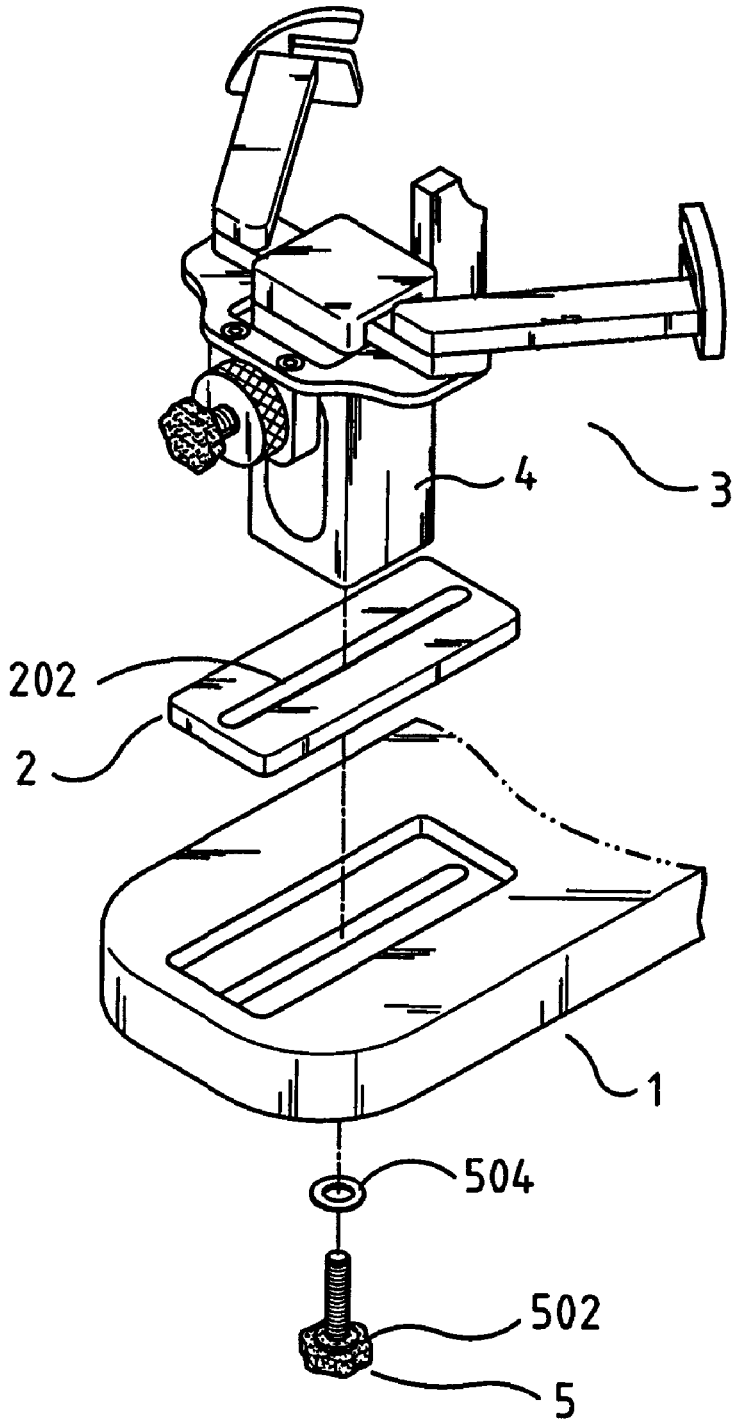
FIG. 1 PRIOR ART
FIG. 1 shows the conventional positioning device of the holing member of the stringing machine.
Figure 2:
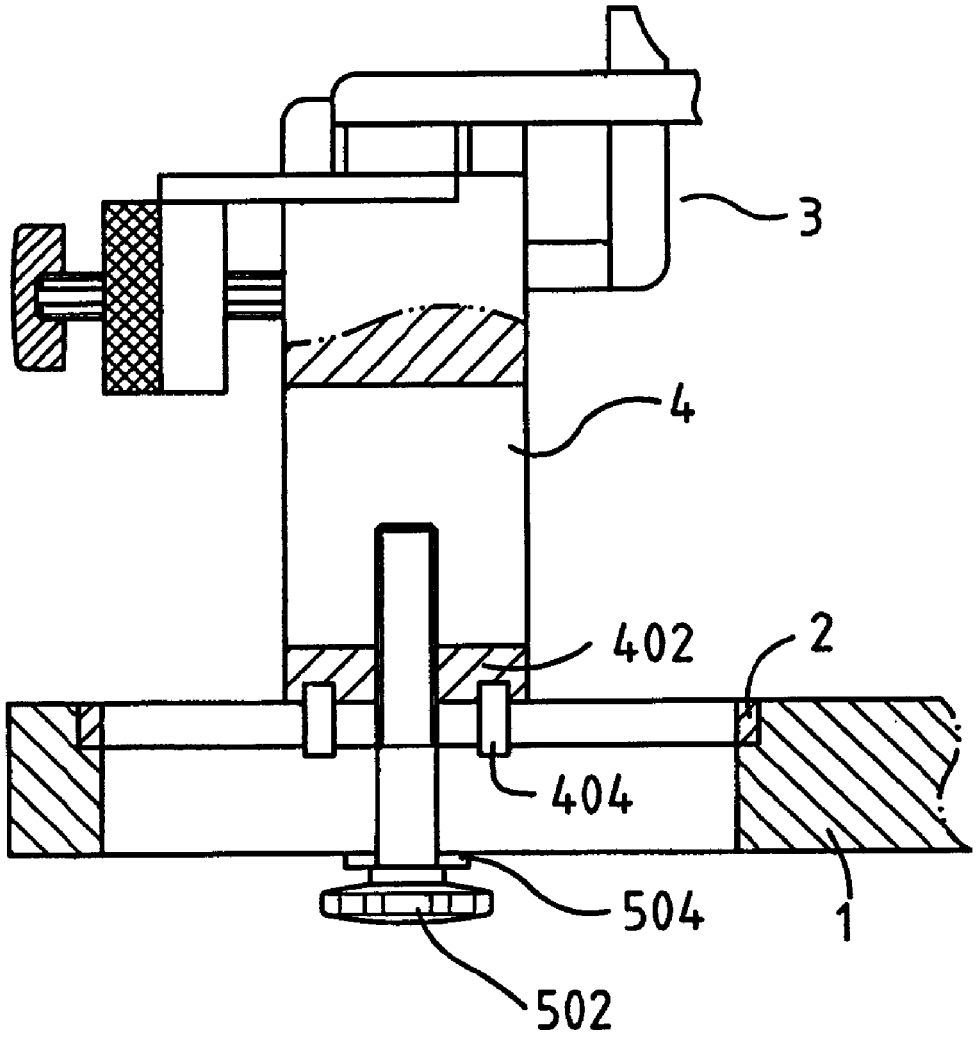
FIG. 2 PRIOR ART
FIG. 2 is a side cross sectional view of the conventional positioning device of the holing member of the stringing machine.
Figure 3:
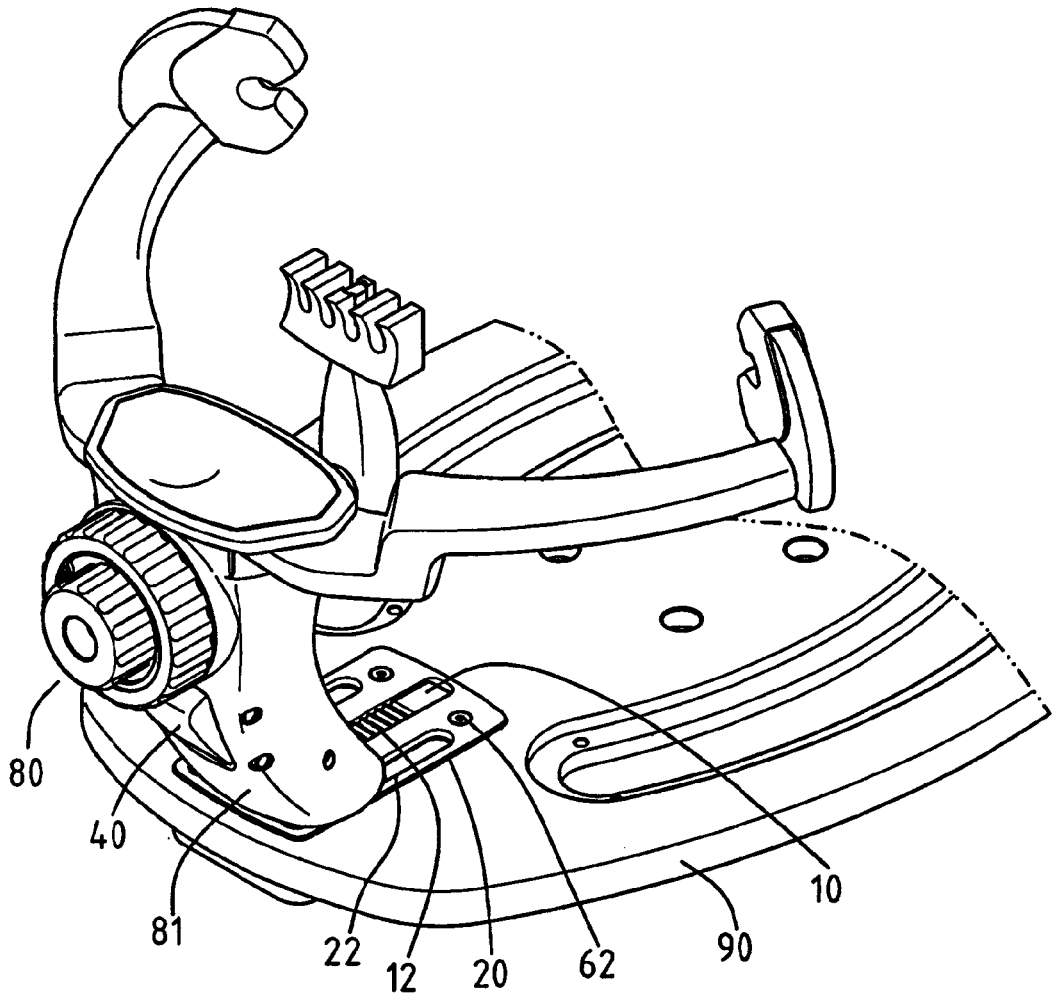
FIG. 3 is a perspective view to show the positioning device of the holing member of the stringing machine of the present invention.
Figure 4:
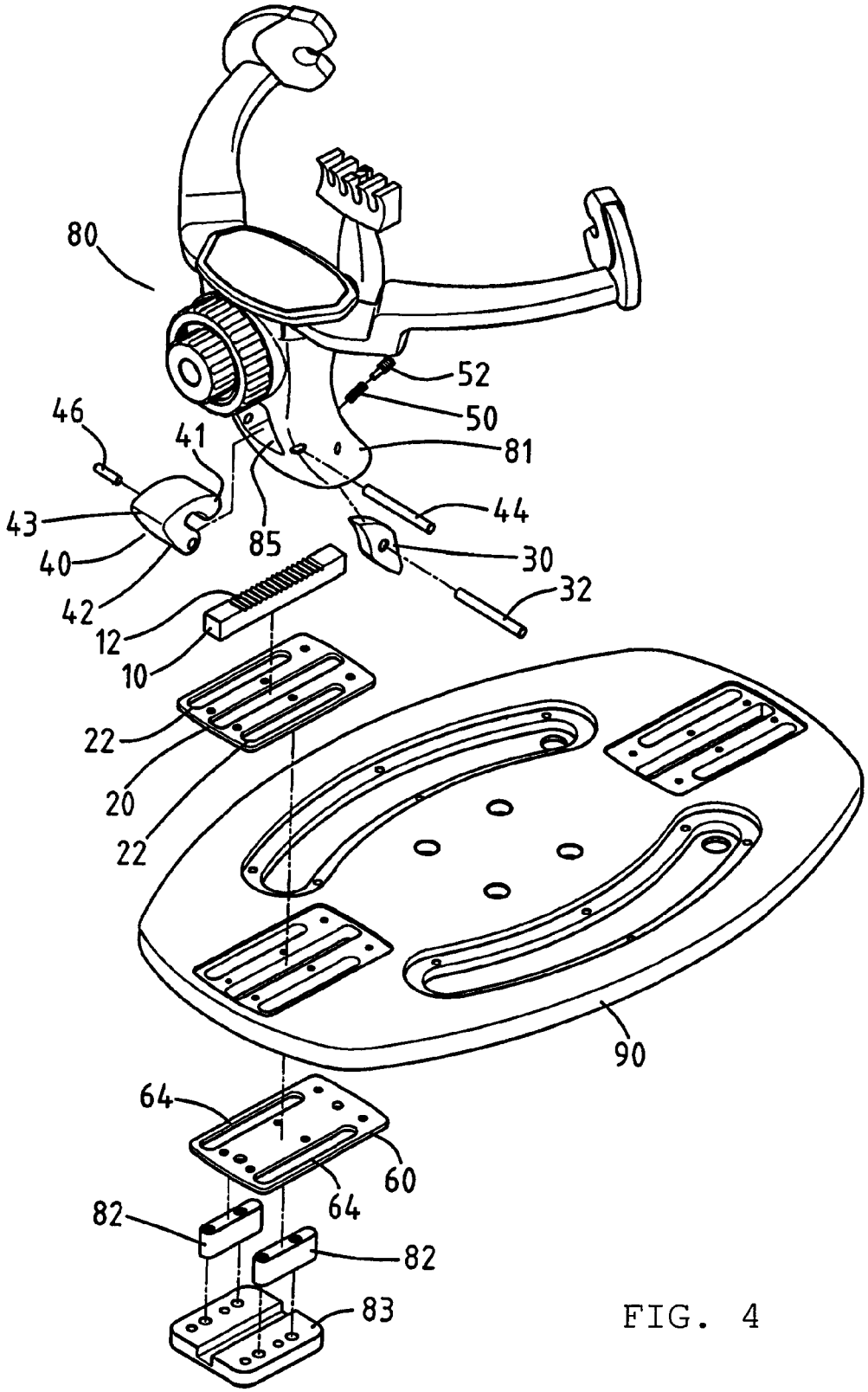
FIG. 4 is an exploded view of the positioning device of the holing member of the stringing machine of the present invention.
Figure 5:
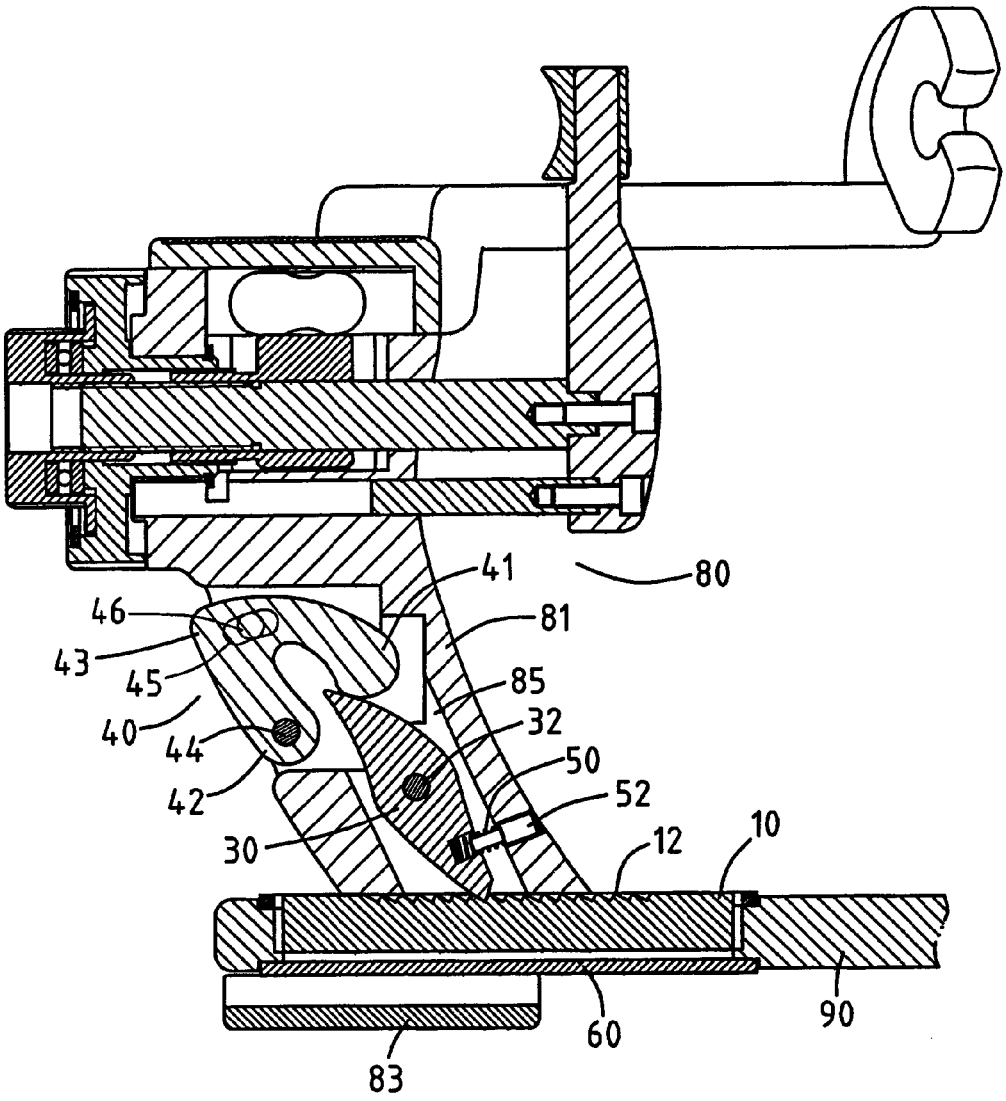
FIG. 5 is a side cross sectional view of the positioning device of the holing member of the stringing machine of the present invention.

Referring to FIGS. 3 to 5, the positioning device for holding member of a sport racket stringing machine comprises a rack 10, a guide board 20, a contact member 30, an operation member 40 and a spring 50. The rack 10 is engaged with the top board 90 of the stringing machine and has multiple one-way ratchet teeth 12 defined in the top thereof. The guide board 20 is connected to the top of the top board 90. The top board 90 has a support board 60 at the underside thereof and the support board 60 is located corresponding to the guide board 20. The support board 60 positions the rack 10. The guide board 20 has two elongate slots 22 defined therethrough and each slot 22 is located parallel to and adjacent to two sides of the rack 10. The support board 60 has two elongate engaging slots 64 which are located corresponding to the slots 22.

The cylindrical body 81 of the holding member 80 is connected to the top of the top board 90 and two blocks 82 are located at the underside of the body 81. The two blocks 82 are respectively engaged with the slots 22 and the engaging slots 64 so that the holding member 80 is able to move along the slots 22 back and forth. A bed member 83 is connected to the underside of the support board 60 so as to position the blocks 82.

The holding member 80 has a body 81 which has a chamber 85 located adjacent to the rack 10. The contact member 30 is movably located in the chamber 85. The contact member 30 has a pivot 32 extending through the central portion thereof and the pivot 32 is pivotably connected between two insides of the chamber 85 so that the contact member 30 is pivotable about the pivot 32. The lower end of the contact member 30 extends toward the rack 10 and is inclinedly engaged with the ratchet teeth 12 of the rack 10 so as to position a holding member 80.

The operation member 40 is pivotably connected to the chamber 85 and is a hook-shaped board. The operation member 40 has a driving portion 41 and a positioning portion 42 respectively located on two ends thereof. A curved operation portion 43 is connected between the driving portion 41 and the positioning portion 42. The operation portion 43 protrudes out from the body 81. The operation member 40 has a pivot 44 at the positioning portion 42 so as to be pivotably connected to the body 81. The operation member 40 has a restriction slot 45 defined in one side thereof and a restriction rod 46 extends through the restriction slot 45. The restriction rod 46 has one end connected to the body 81 to restrict the range of the operation member 40. The top end of the contact member 30 extends between the driving portion 41 and the positioning portion 42, and is located adjacent to the lower end of the driving portion 41. The driving portion 41 pivots the contact member 30 to be disengaged from the rack 10 so as to move the holding member 80 easily and conveniently.

The spring 50 is located in the chamber 85 and connected between the body 81 and the contact member 30 so as to urge the contact member 30 to be in contact with the rack 10. The spring 50 has a first end mounted to a positioning pin 52 which is threadedly connected to the body 81. The distal end of the first end of the spring 50 contacts the inside of the chamber 81. The second end of the spring 50 is connected to the contact member 30 to position the spring 50 which provides a force to keep the contact member 30 engaging with the rack 10.

Figure 6:
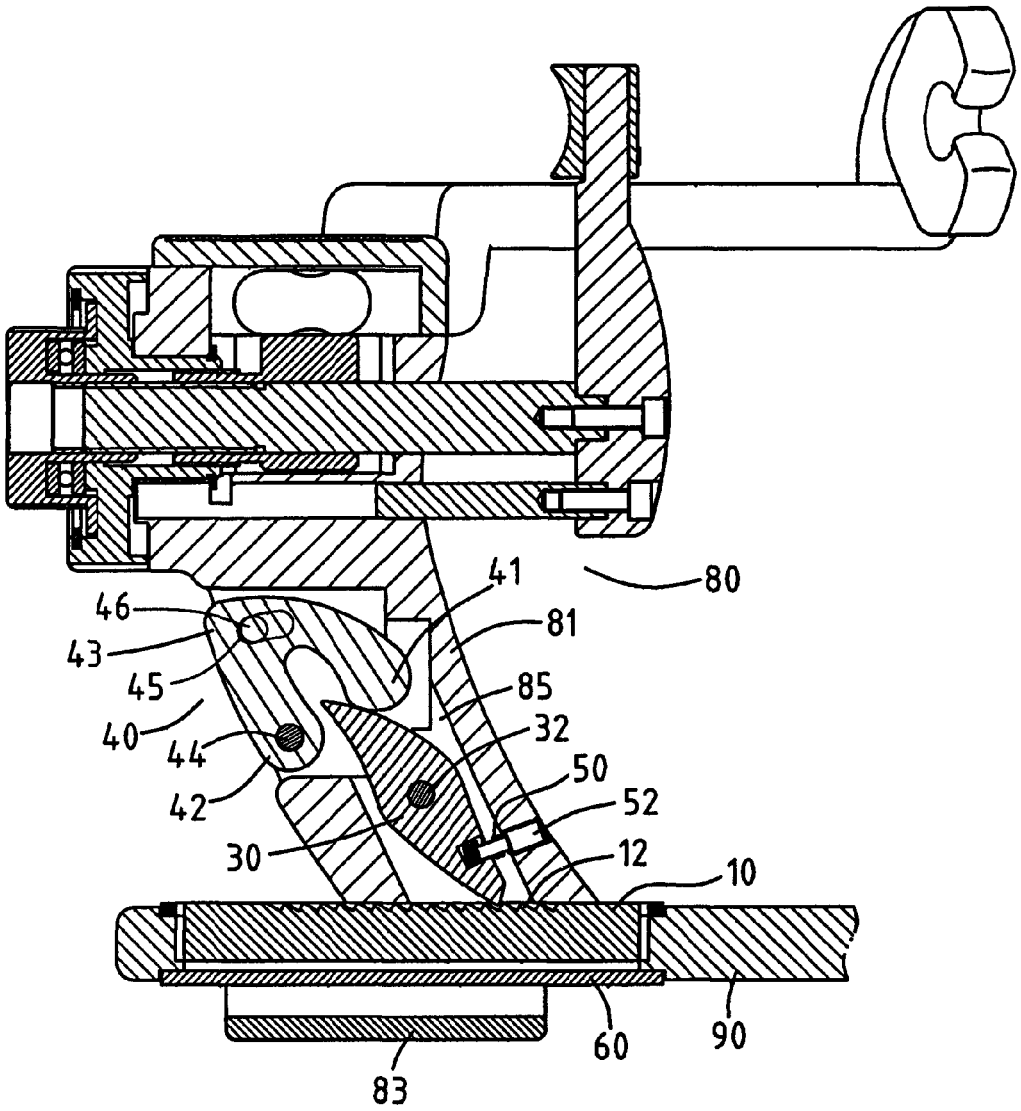
FIG. 6 shows that the positioning device of the holing member of the stringing machine of the present invention is in operation.

Referring to FIGS. 4 to 6, when using the holding member 80, two arms of the holding member 80 are moved toward the two ends of the top board 90 so that the distance between the two arms is increased. By the ratchet teeth 12 of the rack 10, the holding member 80 can be directly moved outward. The contact member 30 is moved over the ratchet teeth 12 of the rack 10 by the spring 50. When the holding member 80 is moved to the desired position, the contact member 30 is engaged with the ratchet teeth 12 of the rack 10 so that the holding member 80 is positioned relative to the rack 10 and does not move toward the center of the top board 90, such that the head of the racket is clamped. As shown in FIG. 6, when pressing the operation portion 43, the operation member 40 is pivoted clockwise about the pivot 44, so that the driving portion 41 pushes the top end of the contact member 30. The contact member 30 is pivoted about the pivot 32 counter clockwise to release the engagement between the contact member 30 and the rack 10. The holding member 80 is then moved inward and toward the center of the top board 90. When the holding member 80 is moved to the desired position, the operation portion 43 is released, and the spring 50 pushes the contact member 30 to be engaged with the ratchet teeth 12 of the rack 10 so that the holding member 80 is positioned.

When the holding member 80 is to be moved outward, the holding member 80 can be directly moved without releasing any restriction devices. When the holding member 80 is to be moved inward, the operation portion 43 of the operation member 40 is pressed, the holding member 80 is then released and can be moved inward easily. The present invention is easily operated and the holding member 80 can be moved easily and conveniently.

While we have shown and described the embodiment in accordance with the present invention, it should be clear to those skilled in the art that further embodiments may be made without departing from the scope of the present invention.

What is claimed is:

1. A positioning device for holding member of a sport racket stringing machine, comprising:

a rack, a contact member, an operation member and a spring, the rack engaged with a top board of the stringing machine and having multiple one-way ratchet teeth defined in a top thereof;

a holding member having a body connected to a top of the top board and the body having a chamber which is located adjacent to the rack;

the contact member movably located in the chamber and a lower end of the contact member extending toward the rack and inclinedly engaged with the ratchet teeth of the rack so as to position a holding member;

the spring located in the chamber and connected between the body and the contact member so as to urge the contact member to be in contact with the rack 10, and the operation member pivotably connected to the chamber and being a hook-shaped board, the operation member having a driving portion and a positioning portion respectively located on two ends thereof, a curved operation portion connected between the driving portion and the positioning portion, the operation portion protruding out from the body, the operation member having a pivot at the positioning portion so as to be pivotably connected to the body, a top end of the contact member extending between the driving portion and the positioning portion and being located adjacent to the lower end of the driving portion, the driving portion pivoting the contact member to move the holding member.

2. The device as claimed in claim 1, wherein the operation member has a restriction slot defined in a side thereof and a restriction rod extends through the restriction slot, the restriction rod has one end connected to the body to restrict a range of the operation member.

3. The device as claimed in claim 1, wherein the contact member has a pivot extending through a central portion thereof and the pivot is pivotably connected between two insides of the chamber so that the contact member is pivotable about the pivot.

4. The device as claimed in claim 1, wherein the spring has a first end mounted to a positioning pin which is threadedly connected to the body, a distal end of the first end of the spring contacts an inside of the chamber, a second end of the spring is connected to the contact member to position the spring.

5. The device as claimed in claim 1, wherein the top board has a support board at an underside thereof and the support board positions the rack.

* * * * *